US009778675B2

(12) United States Patent
Brown et al.

(10) Patent No.: US 9,778,675 B2
(45) Date of Patent: Oct. 3, 2017

(54) FOOT PEDAL FOR A MEDICAL DEVICE HAVING A SELF-LEVELING MECHANISM

(71) Applicant: Ormco Corporation, Orange, CA (US)

(72) Inventors: Erik Brown, Monrovia, CA (US); Ha Le, Fountain Valley, CA (US); Carlos A. Aloise, Alta Loma, CA (US)

(73) Assignee: Ormco Corporation, Orange, CA (US)

( * ) Notice: Subject to any disclaimer, the term of this patent is extended or adjusted under 35 U.S.C. 154(b) by 103 days.

(21) Appl. No.: 14/182,065

(22) Filed: Feb. 17, 2014

(65) Prior Publication Data

US 2015/0230879 A1 Aug. 20, 2015

(51) Int. Cl.
*G05G 23/00* (2006.01)
*G05G 1/48* (2008.04)

(52) U.S. Cl.
CPC ..... *G05G 23/00* (2013.01); *G05G 1/48* (2013.01); *Y10T 74/20528* (2015.01)

(58) Field of Classification Search
CPC ..... G05G 1/305; G05G 1/405; G05G 1/445; G05G 1/40; G05G 1/30; G05G 1/48; H01H 3/14; H01H 3/141; H01H 21/32; H01H 21/26; A61B 2017/00973; A61C 1/0023; G10H 1/348; Y10T 74/20894; Y10T 74/209; Y10T 74/20906; Y10T 74/20528; Y10T 74/2054
See application file for complete search history.

(56) References Cited

U.S. PATENT DOCUMENTS 3,916,722 A * 11/1975 Grobe ..... G05G 1/30 192/129 A
4,639,710 A * 1/1987 McMillan ..... H01C 10/106 200/86.5
4,751,354 A * 6/1988 Walthall ..... H01H 21/26 200/322
5,554,894 A * 9/1996 Sepielli ..... G05G 1/44 307/112
5,983,749 A * 11/1999 Holtorf ..... G05G 1/30 74/478
7,019,234 B1 * 3/2006 Mezhinsky ..... H01H 3/14 200/86.5
7,084,364 B2 * 8/2006 Mezhinsky ..... H01H 3/14 200/310
7,626,132 B2 * 12/2009 Mezhinsky ..... A61F 9/00736 200/86.5

(Continued)

*Primary Examiner* — Daniel Yabut
(74) *Attorney, Agent, or Firm* — Wood Herron & Evans LLP

(57) ABSTRACT

A foot pedal for a medical device for placement on a working surface of a medical operatory includes a housing defining a reference plane; a cord having a first end coupled to the housing and a second end configured to be coupled to the medical device; and an actuator coupled to the housing and configured to be actuated by a user to provide a control function to the medical device, wherein the housing includes a self-leveling mechanism for urging the placement of the foot pedal on the working surface in an upright orientation. The self-leveling mechanism may include an engagement tab extending from the housing and configured to be the first aspect of the foot pedal to contact the working surface. The self-leveling mechanism may additionally or alternatively include a cord guide configured to pitch or cant the housing in a preferential direction.

17 Claims, 7 Drawing Sheets

(56) References Cited

U.S. PATENT DOCUMENTS

| | | | | | |
|---|---|---|---|---|---|
| D623,209 | S * | 9/2010 | Matuschek | D13/167 | |
| 8,465,473 | B2 * | 6/2013 | Horvath | A61B 17/32002 | 200/86.5 |
| D699,441 | S * | 2/2014 | Leblanc | D3/289 | |
| D708,593 | S * | 7/2014 | Lynn | D13/179 | |
| D713,529 | S * | 9/2014 | Li | D13/167 | |
| D727,498 | S * | 4/2015 | Creed | D13/167 | |
| D768,091 | S * | 10/2016 | Lewis | D13/167 | |
| 2004/0035242 | A1 * | 2/2004 | Peterson | G05G 1/30 | 74/560 |
| 2004/0106915 | A1 * | 6/2004 | Thoe | A61B 17/00 | 606/1 |
| 2006/0219049 | A1 * | 10/2006 | Horvath | A61B 17/00 | 74/560 |
| 2008/0243105 | A1 * | 10/2008 | Horvath | A61B 17/32002 | 606/1 |
| 2011/0098721 | A1 * | 4/2011 | Tran | H01H 21/26 | 606/130 |
| 2014/0135785 | A1 * | 5/2014 | Tran | H01H 21/26 | 606/107 |
| 2014/0364864 | A1 * | 12/2014 | Lynn | A61F 9/00745 | 606/107 |

* cited by examiner

FOOT PEDAL FOR A MEDICAL DEVICE HAVING A SELF-LEVELING MECHANISM

TECHNICAL FIELD

The invention relates generally to foot pedals used in medical operatories, and more particularly to a foot pedal for a medical device that facilitates the proper orientation of the foot pedal on a working surface of the operatory.

BACKGROUND

There are a wide range of medical industries and medical devices that utilize a foot pedal to implement some type of control over the medical device. In this regard, many dental operatories include dental instruments that may be operated in some manner by a foot pedal operatively coupled to the instrument. By way of example, in the dental field, foot pedals may be used to control various motors, burs, ultrasonic probes, suctioning devices, and a host of other dental instruments. Depending on the particular procedure being performed, clinicians or staff personnel will prepare the operatory by removing certain medical devices and their associated foot pedals from the operating environment, and setting up certain other medical devices and their associated foot pedals to the operating environment. In the course of a typical day, clinicians perform multiple procedures using multiple different instruments. Accordingly, staff personnel may be repeatedly assembling and disassembling a wide array of medical devices and associated foot pedals throughout the day.

One challenge of this process deals with the proper orientation of the foot pedal on the floor in the medical operatory. In this regard, during the assembly of the medical devices, many staff personnel will attempt to position the foot pedal on the floor by holding the foot pedal by its cord and slowly lowering the foot pedal to the floor. This technique is considered desirable because it is often easier, in that the staff person does not have to bend down to the floor, and this technique also keeps the person's hands away from surfaces that may be susceptible to the collection of dirt and other debris. In any event, as the foot pedal nears and contacts the floor, in some instances the foot pedal may orient itself so as to be upside down and in what may be referred to as a turtled position.

At this point, the staff person has a few options to correct the orientation of the foot pedal. One option is to simply reach down to the floor, pick the foot pedal up, and manually turn the foot pedal over to its proper, upright orientation. As noted above, however, this places the person's hands near an undesirable surface and requires the person to bend over to the floor, both of which may be considered undesirable. Another option is to manipulate the cord from above in order to right the foot pedal. This may require, for example, the person to quickly jerk or whip the cord in a certain manner in order to turn the pedal over. Yet another option is for the staff person to pull the cord upwardly so as to lift the foot pedal back off the floor, and then lower it once again in an attempt to position the foot pedal in its proper, upright orientation. These latter two options, however, tend to be time consuming and frustrating to many clinicians and staff personnel.

In addition to the above, foot pedals may also occasionally flip over during a medical procedure. In this case, the clinician may need to right the foot pedal quickly and without a significant risk of contamination. Thus, cord manipulation is preferably used in an attempt to flip the foot pedal back over. As it may take several attempts to right the foot pedal using this technique, clinicians may become frustrated at the lack of a quick and reliable way in which to properly orient the foot pedal on the floor.

Accordingly, there is a need for a foot pedal which may be quickly, easily, and reliably positioned on the floor of the medical operatory in its proper, upright orientation.

SUMMARY

A foot pedal for a medical or dental device includes a housing, wherein the housing has a self-orienting mechanism to orient the foot pedal in an upright position. The self-orienting mechanism includes an engagement tab, wherein the engagement tab is configured to contact the floor when the foot pedal is lowered to the floor. The foot pedal is configured to orient the foot pedal to the upright position when the foot pedal contacts the floor. The engagement tab also extends from the housing and may be resilient. The housing further includes a base surface. The engagement tab may be angled relative to the base surface between about 20° and about 75°.

In another embodiment, a foot pedal for a medical or dental device includes a housing, wherein the housing includes a base surface and a self-orienting mechanism to orient the foot pedal in an upright position, and a cord coupled to the housing. The self-orienting mechanism includes a cord guide at the interface between the cord and the housing, wherein the cord guide angles the cord from the base surface. The cord guide angles the cord so that the angle of the cord relative to the base surface is between about 5° and about 45°. The cord guide may include a raised boss with an open channel formed in a surface thereof and configured to receive the cord, wherein the open channel forms an acute angle relative to the base surface. For example, the open channel may be angled relative to the base surface between about 5° and about 45°.

In another embodiment, a foot pedal for a medical or dental device configured for placement on a working surface of a medical operatory includes a housing defining a reference plane at a location where the housing is configured to engage the working surface during use; a cord having a first end coupled to the housing and a second end configured to be coupled to the medical device; and an actuator coupled to the housing and configured to be actuated by a user to provide a control function to the medical device, wherein the housing includes a first self-leveling mechanism for urging the placement of the foot pedal on the working surface in an upright orientation.

In one embodiment, the first self-leveling mechanism includes an engagement tab extending away from the housing, wherein the engagement tab is configured to be the first aspect of the foot pedal that contacts the working surface when the foot pedal is being lowered toward the working surface by the cord. The engagement tab includes a contact region configured to be the first aspect of the engagement tab to contact the working surface as the foot pedal is being lowered toward the working surface by the cord. The contact region has a height above the reference plane that is greater than the height of the foot pedal's center of gravity above the reference plane. This promotes a moment about the contact point in a direction toward the proper, upright orientation of the foot pedal. For example, the height of the contact region above the reference plane is between about 110% and about 160% of the height of the foot pedal's center of gravity above the reference plane.

In one embodiment, the engagement tab extends from the housing at a location generally opposite to where the cord extends from the housing. Additionally, in an exemplary embodiment the engagement tab is flexible to allow the tab to flex out of the way when contacted by the clinician's foot, for example. Moreover, at least an outer aspect of the engagement tab forms an acute angle relative to the reference plane. For example, at least an outer aspect of the engagement tab is angled relative to the reference plane between about 20° and about 75°.

In one embodiment, the foot pedal may include a second self-leveling mechanism, wherein the second self-leveling mechanism includes a cord guide at the interface between the cord and the housing. The cord guide is configured to pitch the housing so as to form an acute angle between a vertical axis and the reference plane when the foot pedal is being freely held by the cord. For example, in an exemplary embodiment, the cord guide pitches the housing so that the angle between the vertical axis and the reference plane is between about 5° and about 45°. In one embodiment, the cord guide includes a raised boss having an open channel formed in a surface thereof that is configured to receive the cord therein. The open channel forms an acute angle relative to the reference plane. For example, in an exemplary embodiment, the open channel is angled relative to the reference plane between about 5° and about 45°.

In yet another embodiment, the first self-leveling mechanism includes a cord guide at the interface between the cord and the housing. The cord guide is configured to pitch the housing so as to form an acute angle between a vertical axis and the reference plane when the foot pedal is being freely held by the cord. For example, in an exemplary embodiment, the cord guide pitches the housing so that the angle between the vertical axis and the reference plane is between about 5° and about 45°. In one embodiment, the cord guide includes a raised boss having an open channel formed in a surface thereof that is configured to receive the cord therein. The open channel forms an acute angle relative to the reference plane. For example, in an exemplary embodiment, the open channel is angled relative to the reference plane between about 5° and about 45°.

In one embodiment, the foot pedal housing has a two-part construction including an upper housing portion and a lower housing portion. The upper housing portion is configured to receive the actuator and the lower housing portion includes the first self-leveling mechanism. The lower housing portion may also include the second self-leveling mechanism in embodiment having two such mechanisms. The first and second housing portions may be selectively coupled together and may be formed from different materials.

In yet another embodiment, a foot pedal for a medical device configured for placement on a working surface of a medical operatory includes a housing defining a reference plane at a location where the housing is configured to engage the working surface during use; a cord having a first end coupled to the housing and a second end configured to be coupled to the medical device; and an actuator coupled to the housing and configured to be actuated by a user to provide a control function to the medical device, wherein the housing includes a first and a second self-leveling mechanism for urging the placement of the foot pedal on the working surface in an upright orientation. The first self-leveling mechanism includes an engagement tab extending away from the housing, wherein the engagement tab is configured to be the first aspect of the foot pedal that contacts the working surface when the foot pedal is being lowered toward the working surface by the cord. The second self-leveling mechanism includes a cord guide at the interface between the cord and the housing. The cord guide is configured to pitch the housing so as to form an acute angle between a vertical axis and the reference plane when the foot pedal is being freely held by the cord.

BRIEF DESCRIPTION OF THE DRAWINGS

The accompanying drawings, which are incorporated in and constitute a part of this specification, illustrate an embodiment of the invention and, together with a general description of the invention given above, and the detailed description given below, serve to explain the invention.

DETAILED DESCRIPTION

Figure 1:
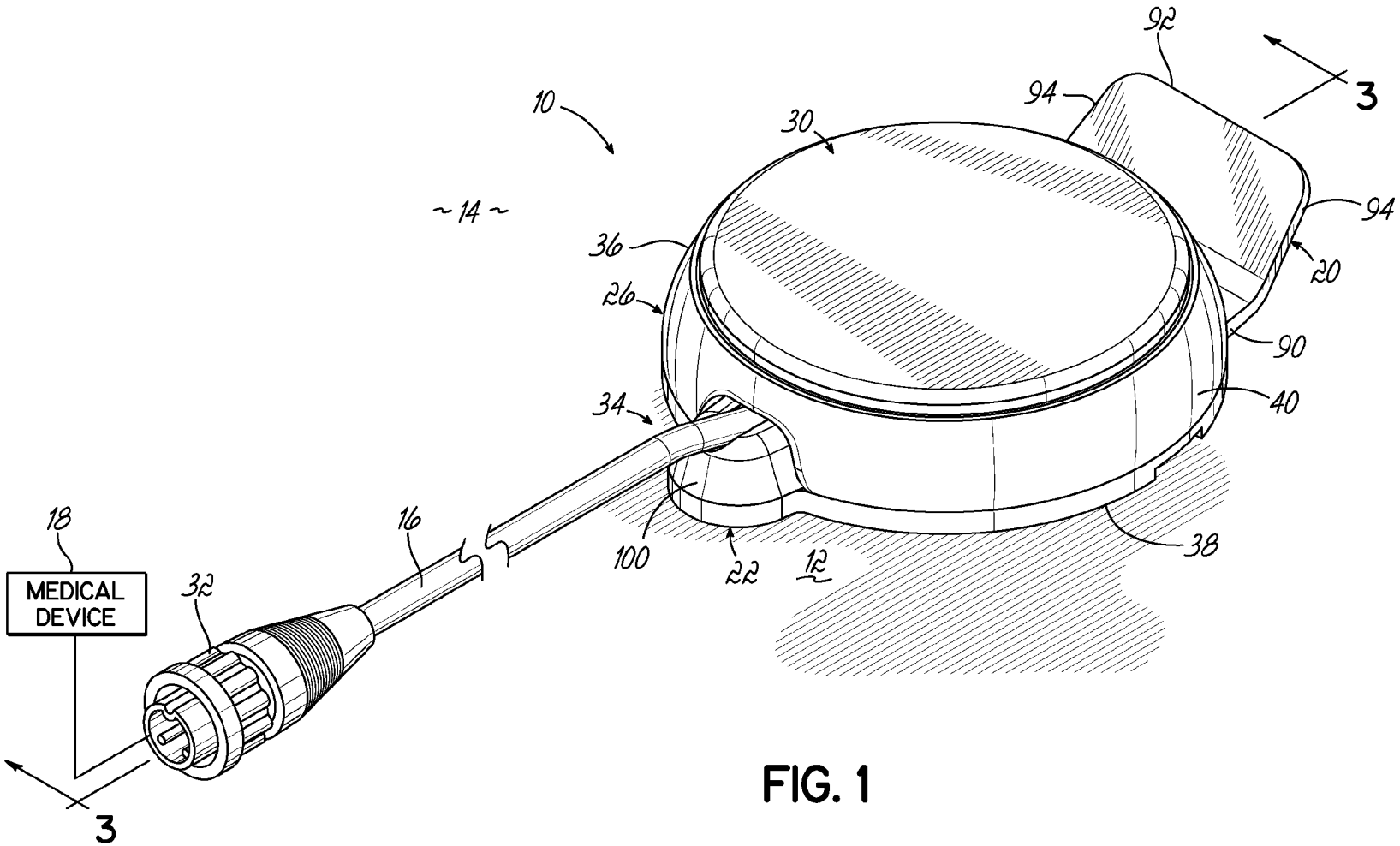
FIG. 1 is a perspective view of a foot pedal in accordance with an embodiment of the invention.

With reference to FIG. 1, a foot pedal 10 in accordance with an embodiment of the invention is illustrated in its proper, upright position on a working surface 12 of a medical operatory 14, which may be provided by the floor or some other support surface in the operatory 14. The foot pedal 10 includes a cord 16 for operatively coupling the foot pedal 10 to a medical device or instrument, shown schematically at 18 (FIG. 1), which may be used during a medical procedure in the operatory 14. When the foot pedal 10 is coupled to the medical device 18, the foot pedal 10 provides a control function to the operation of the device 18. The foot pedal 10 may be used with a wide variety of medical devices and in a wide variety of medical fields. By way of example and without limitation, the foot pedal 10 may be used in connection with operation of dental instruments, such as an endodontic motors, endodontic obturation equipment, scalers, motors (e.g., for endodontic and implant applications, etc.), turbines (for burs, etc.), extrusion machines, dental chair controls, and other dental equipment and instruments. However, aspects of the invention are not limited to applications in the dental field, but may provide benefits to a broader range of medical devices.

As will be discussed more fully below, in accordance with aspects of the present invention, the foot pedal 10 includes at least one self-leveling or self-orienting mechanism that facilitates the proper orientation of the foot pedal 10 on the working surface 12 when being lowered down to the working surface 12 by the cord 16. In one embodiment, the self-leveling mechanism may include an engagement tab 20 extending from the foot pedal 10. In this embodiment, the engagement tab 20 is configured to be the first aspect of the foot pedal 10 that engages the working surface 12 as the foot pedal 10 is lowered toward the working surface 12 by the cord 16. The engagement tab 20 is further configured such that when the tab 20 engages the working surface 12, further lowering of the foot pedal 10 urges the foot pedal 10 toward the proper, upright orientation. In another embodiment, the self-leveling mechanism may include a cord guide 22 at the interface between the cord 16 and the housing of the foot pedal 10. In this embodiment, the cord guide 22 provides an advantageous spatial relationship between the cord 16 and the housing of the foot pedal 10 when the foot pedal 10 is freely hanging by the cord 16 such that when the foot pedal 10 engages the working surface 12, further lowering of the foot pedal 10 urges the foot pedal 10 toward the proper, upright orientation. Each of these self-leveling or self-orienting mechanisms will be discussed in more detail below.

It should be recognized that in certain embodiments, the foot pedal 10 may include only one of the self-leveling mechanisms described above to overcome the drawbacks of current foot pedal designs. However, in an alternative embodiment, the foot pedal 10 may include both of the self-leveling mechanisms described above. For sake of brevity, the foot pedal 10, as shown in FIGS. 1-4B and described herein, includes both self-leveling mechanisms. It should be recognized, however, that foot pedals having only one of the self-leveling mechanisms are within the scope of the present invention, as each may provide a benefit relative to current foot pedal designs (see FIGS. 5 and 6).

As illustrated in the figures, in an exemplary embodiment, the foot pedal 10 includes a pedal housing 26 defining an interior cavity 28, a cord 16 extending away from the housing 26 and configured to be coupled to a medical device 18, and an actuator 30 configured to be actuated by a clinician to provide a control function for the medical instrument 18 to which the foot pedal 10 is attached. The cord 16 is coupled to the housing 26 at one end thereof, such as to various electrical components located within the interior cavity 28 of the housing 26, and may include a connector 32 at another end thereof to facilitate coupling of the cord 16 to the medical device 18. Thus, the cord 16 is configured to extend through the wall of the housing 28 at a housing interface 34. Such cords 16 and connectors 32 are generally known in the art and thus will not be discussed in further detail.

The actuator 30 may in an exemplary embodiment be in the form of a button or pad positioned along an upper part of the housing 26 so as to effectively close off the interior cavity 28 of the housing 26. In one embodiment, the actuator 30 may be generally circular in shape, and be made from a durable material such as, for example, stainless steel. Of course, other shapes and materials may also be used to form the actuator 30. In an exemplary embodiment, the actuator 30 may be movably coupled to the housing 26, thereby allowing the actuator 30 to be depressible or otherwise movable relative to the housing 26 to provide some level of control over the medical device 18. To focus the discussion and illustrations to the more inventive aspects (e.g., the structural features of the housing 26), the various electronic components located in the housing 26 that allow the foot pedal 10 to control the medical device 18 in a desired manner, and the springs or other biasing mechanisms that movably couple the actuator 30 to the housing 26 have been omitted. One of ordinary skill in the art understands, however, the various electronic components and biasing mechanisms that are to be located in the housing 26 of the foot pedal 10 to achieve the desired operation. Thus, whether the foot pedal 10 is a simple on/off switch for the medical device 18, or provides another functional aspect to the medical device 18, it is generally known in the art what components to include in the foot pedal 10 to achieve the desired function. As these components form no part of the present invention, they have been omitted to more clearly focus on the inventive aspects and will not be discussed in further detail.

Figure 2:
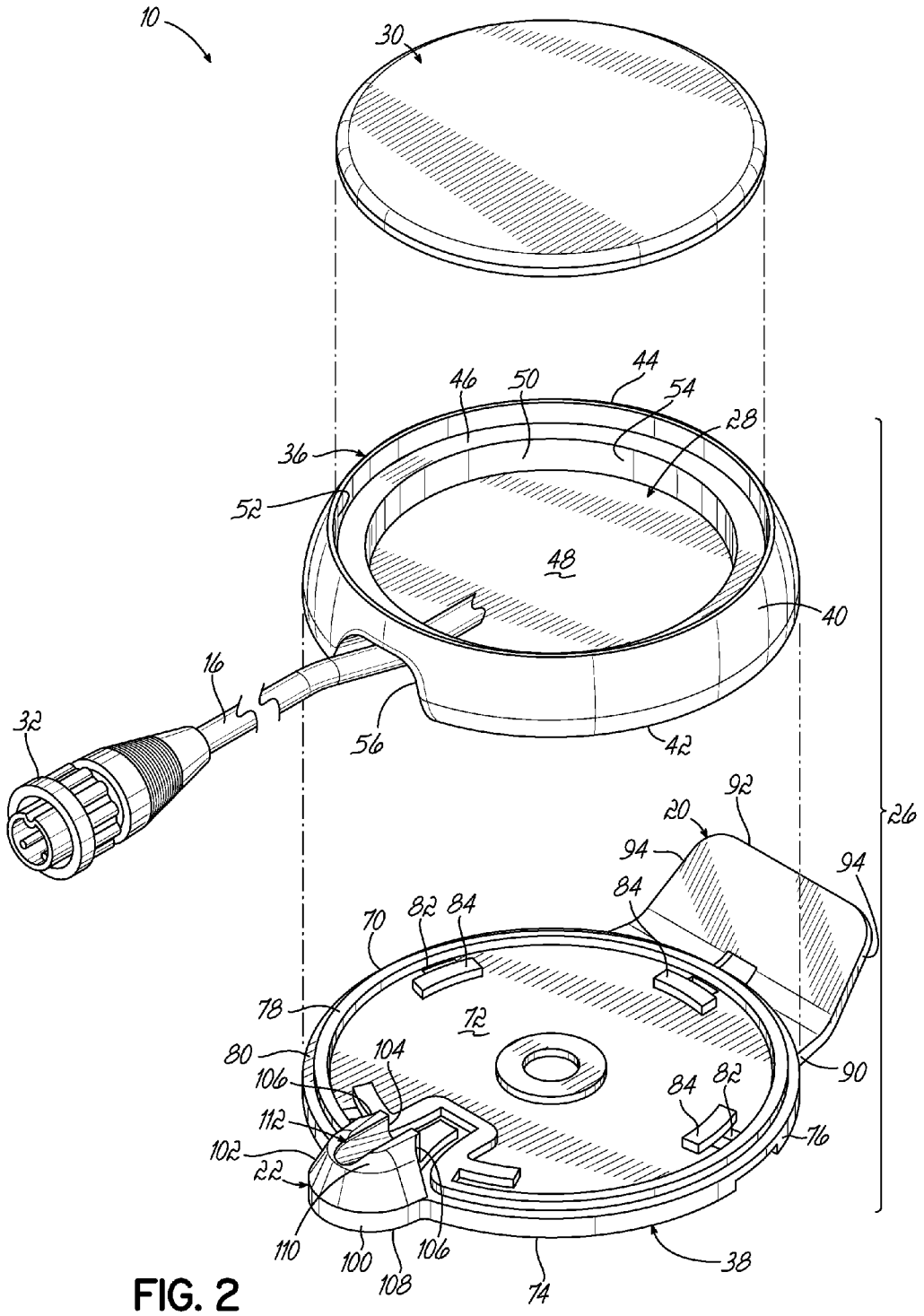
FIG. 2 is a disassembled perspective view of the foot pedal shown in FIG. 1.

In one embodiment, the housing 26 has a two-part design including an upper housing portion 36 and a lower housing portion 38 which may be coupled together to collectively form the pedal housing 26. The upper housing portion 36 may be generally disc-shaped in an exemplary embodiment and include a generally circular side wall 40 having a bottom end 42 and a top end 44, a circular lip or shoulder 46 spaced from the top end 44 and adjacent to and on the interior side of the side wall 40, and a bottom wall 48 spaced from the shoulder 46 by an inner side wall 50 (FIG. 2). Accordingly, the interior cavity 28 may include an upper cavity portion 52, defined at least in part by the outer side wall 40 and the shoulder 46, and a lower cavity portion 54, defined by the bottom wall 48 and the inner side wall 50. The upper cavity portion 52 may be configured to receive the actuator 30, and the lower cavity portion 54 may be configured to receive any number of components that facilitate operation of the foot pedal 10, as mentioned above. In this regard, the bottom wall 48 may include any number of openings or features that allow such components to be coupled to the housing 26 (not shown).

Figure 3:
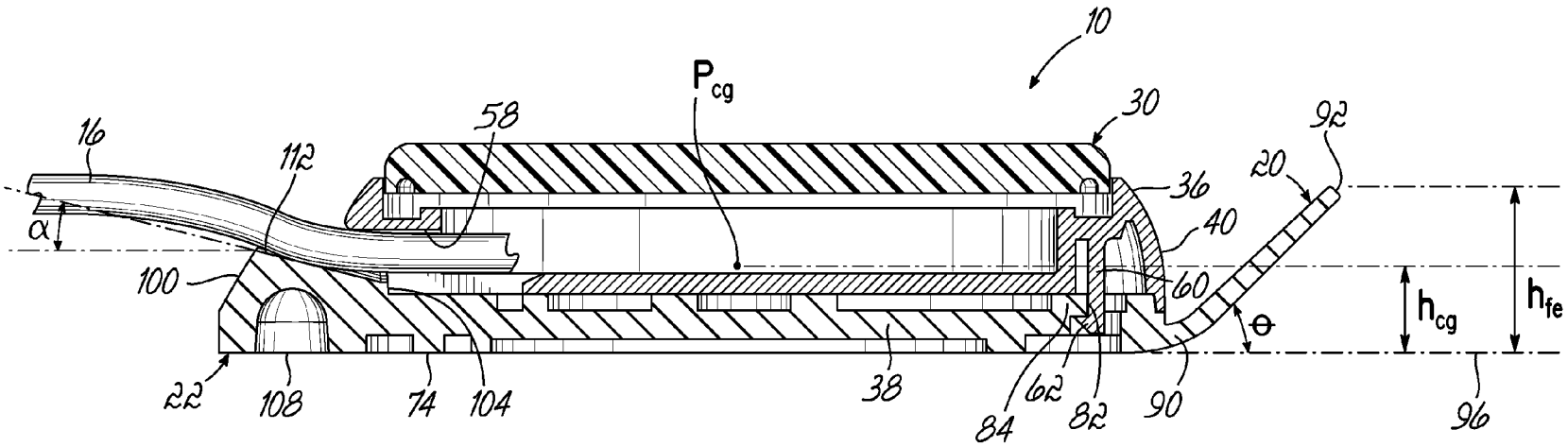
FIG. 3 is a cross-sectional view of the foot pedal shown in FIG. 1 generally taken along the line 3-3.

The upper housing portion 36 also includes a contoured recess 56 open to the outer side wall 40 and extending inwardly and terminating in an opening 58 (FIG. 3) through the inner side wall 50 and possibly the bottom wall 48 such that the recess 56 is in communication with the interior cavity 28 of the housing 26, and more particularly, in communication with the lower cavity portion 54. As explained in more detail below, this recess 56 and opening 58 allow the cord 16 to extend within the housing 26. Additionally, as illustrated in FIG. 3, to facilitate a coupling between the upper and lower housing portions 36, 38, the upper housing portion 36 may include one or more generally resilient clips 60 having a j-shaped tip 62 that provides a snap-fit connection with the lower housing portion 38. In one embodiment, for example, the clips 60 may depend from the underside of the shoulder 46 and extend downwardly below the bottom end 42 of the side wall 40. However, other locations for the clips 60 may also be possible. In an exemplary embodiment, the upper housing portion 36 may be formed through an injection molding process using various engineering plastic materials. By way of example and without limitation, the upper housing portion 36 may be formed from a polycarbonate, acrylinitrile butadiene stryrene (ABS), or other suitable plastic materials. However, the invention is not limited to the upper housing portion 36 being a molded body or being formed from a plastic material. Other manufacturing methods and other materials are also contemplated to be within the scope of the present invention.

The lower housing portion 38 may also be generally disc-shaped in an exemplary embodiment and include a generally circular, plate-like main body 70 having an upper surface 72, a lower base surface 74 and a side wall 76. A rib 78 may project from the upper surface 72 adjacent the side wall 76 to define a seat 80 configured to receive a portion of the upper housing portion 36, and more particularly, to receive the lower end 42 of the outer side wall 40 in a relatively snug fit. Additionally, the main body 70 may include one or more through bores 82 configured to generally align with the resilient clips 60 on the upper housing portion 36 and receive a corresponding clip 60 during assembly of the housing 26. For purposes described below, one or more abutment blocks 84 may project from the upper surface 72 of the main body 70 and extend across a portion of a corresponding through bore 82 so as to partially occlude the opening defined by the through bore 82 from above.

To assemble the upper and lower housing portions 36, 38, the clips 60 on the upper housing portion 36 are generally axially aligned with the through bores 82 in the lower housing portion 38 and then the two housing portions 36, 38 are moved toward one another. As the two housings 36, 38 move together, the j-shaped tips 62 of the clips 60 engage the upper end of the abutment blocks 84 and are cammed or flexed slightly outwardly to a biased state of the clips 60. As the two housings 36, 38 are moved further together, the j-shaped tips 62 may slide along the sides of the abutments blocks 84 and then snap back inwardly under the bias or elastic energy stored in the clips 60 so that the j-shaped tips 62 now reside beneath the lower surface of the abutment blocks 84. This secures the upper and lower housing portions 36, 38 together to form the housing 26. Furthermore, the upper and lower housing portions 36, 38 may be disassembled. In this regard, the j-shaped tips 62 of the clips 60 may be accessed from the lower surface 74 of the main body 70 and flexed outwardly, such as by using a suitable tool, to thereby release the clips 60 from beneath the abutment blocks 84 and allow the two housing portions 36, 38 to be separated from each other by moving the housing portions 36, 38 in opposite directions.

In accordance with an aspect of the invention, the lower housing portion 38 may include one or both of the self-leveling or self-orienting mechanisms discussed above configured to provide a proper, upright orientation of the foot pedal 10 on the working surface 12. In this regard, and in one exemplary embodiment, the lower housing portion 38 may include the engagement tab 20 extending away from the main body 70. The engagement tab 20 may have a generally rectangular configuration including an edge 90 coupled to the main body 70, a free end 92 generally opposite the edge 90, and a pair of side edges 94 extending therebetween. The side edges 94 may be straight and generally parallel to each other (not shown), or have a tapered configuration, such as being slightly tapered inwardly toward each other (FIGS. 1 and 2). It should be recognized, however, that the engagement tab 20 may have outer configurations and the tab 20 is not limited to that shown and described herein.

In an exemplary embodiment, and as illustrated in FIG. 3, the engagement tab 20 may be bent in an upwardly direction such that the free end 92 of the tab 20 is located above a reference plane 96 defined by the lower base surface 74 of the lower housing portion 38. The reference plane 96 is defined so as to essentially be coplanar with the working surface 12 when the foot pedal 10 is properly positioned thereon. In one aspect of the invention, the height $h_{fe}$ of the free end 92 of the engagement tab 20 from the reference plane 96 is selected to urge the foot pedal 10 toward the proper orientation during an assembly or correction procedure of the foot pedal 10. More particularly, and for reasons described more fully below, the height $h_{fe}$ of the free end 92 of the engagement tab 20 from the reference plane 96 is selected to be greater than the height $h_{cg}$ of the foot pedal's 10 center of gravity $P_{cg}$ from the reference plane 96. By way of example, and without limitation, the free end height $h_{fe}$ of the engagement tab 20 may be between about 110% and about 160% of the center of gravity height $h_{cg}$ (defined by $h_{fe}/h_{cg}\times100$) Other values greater or less than this may be used depending on the particular application. One of ordinary skill in the art will understand how to determine the center of gravity $P_{cg}$ of the foot pedal 10, and thus no further discussion of that process is described herein.

In addition to the above, the engagement tab 20 may be generally bent upwardly so that at least a generally planar outer portion or aspect of the tab 20 generally forms an acute angle θ relative to the reference plane 96. By way of example and without limitation, the angle θ may be between about 20° and about 75°, but in an exemplary embodiment is about 45°. Of course other angles may be used depending on the particular application.

In an exemplary embodiment, the lower housing portion 38 further includes a cord guide 22 configured as a raised boss 100 extending from the side wall 76 of the main body 70 and above the upper surface 72 thereof. In one embodiment, the raised boss 100 includes an arcuate side wall 102, a generally planar side wall 104, a pair of tapered or chamfered side walls 106 between the arcuate and planar side walls 102, 104, a bottom wall 108 and a top wall 110 (FIG. 2). The raised boss 100 includes an open groove or channel 112 in the top wall 110, which as discussed in more detail below, is configured to receive the cord 16 therein. In an exemplary embodiment, the channel 112 may have a U-shaped cross-sectional profile, but other cross-sectional profiles may be possible.

In accordance with an aspect of the present invention, the channel 112 in the raised boss 100 is angled slightly upward in a direction from an inner side of the raised boss 100 toward an outer side of the raised boss 100. This angling of the channel 112 may be described relative to reference plane 96. In this regard, the outer end of the channel 112 may be at a height above the reference plane 96 that is greater than the height of the inner end of the channel above the reference plane 96. In this regard, the channel 112 (e.g., the trough of the U-shaped channel) may form an acute angle α relative to the reference plane 96. By way of example and without limitation, the channel 112 may be angled relative to reference plane 96 between about 5° and about 45°. In an exemplary embodiment, the channel 112 may be angled relative to the reference plane 96 about 15°. It should be appreciated, however, that greater or lesser angled values may be used depending on the particular application.

As illustrated in the figures, when the upper and lower housing portions 36, 38 are coupled together, at least a portion of the raised boss 100 is received within the contoured recess 56 such that, for example, the chamfered side walls 106 are confronting, and possibly engaging, the walls that define the contoured recess 56 (FIG. 1). The cord 16 is received in the channel 112 so as to be tightly pressed against the floor of the channel 112 and extends into the interior cavity 28 of the housing 26 through the opening 58 (FIG. 3). In an exemplary embodiment, the engagement tab 20 is positioned generally opposite to the cord/housing interface. In this regard, a centerline of the engagement tab 20 may be generally aligned with a longitudinal axis of the cord 16 or a centerline of the channel 112 in the raised boss 100, such as when the foot pedal 10 is being freely held by the cord 16 (see below), the cord 16 and the engagement tab 20 are substantially about 180° offset from each other. However, it is believed that a slight misalignment between the two, e.g., about ±10° will not significantly impact the intended function of the engagement tab 20 during use.

In an exemplary embodiment, the lower housing portion 38, including the engagement tab 20 and/or the cord guide 22 may also be formed through an injection molding process using various engineering plastic materials. In other words, the engagement tab 20 and the cord guide 22 may be integrally formed with the main body 70 so as to define a monolithic structure. In an alternative embodiment, however, the engagement tab 20 and/or the cord guide 22 may be separate elements which are coupled to the main body 70 through some connector (e.g., screws, rivets, etc.) or coupling process (e.g., welding, adhesives, etc.). Thus, aspects of the invention are not limited to the integral construction of the lower housing portion 38 described herein.

In one embodiment, the plastic material may be selected to provide the engagement tab 20 with a certain amount of resiliency or flexibility. This would allow, for example, the tab 20 to perform its intended function, but yet not significantly interfere with a clinician's operation of the foot pedal 10. In other words, if a clinician's foot engages or presses the engagement tab 20, the tab 20 is able to flex out of the way so as not to significantly disturb operation of the foot pedal 10. To this end, the lower housing portion 38 may be formed of a medium durometer plastic material. More particularly, in an exemplary embodiment, the lower housing portion 38 may be formed from santoprene rubber having a durometer in the range between about 30 Shore A and about 60 Shore A. Other materials, such as other thermoplastic materials, and other durometer values may be used depending on the particular application. For example, in an alternative embodiment, the engagement tab 20 (and possibly the entire lower housing portion 38) may be substantially rigid. In a further alternative embodiment, the engagement tab 20 has a certain level of flexibility while the remaining aspects of the lower housing portion 38 are relatively rigid.

Figure 4A:
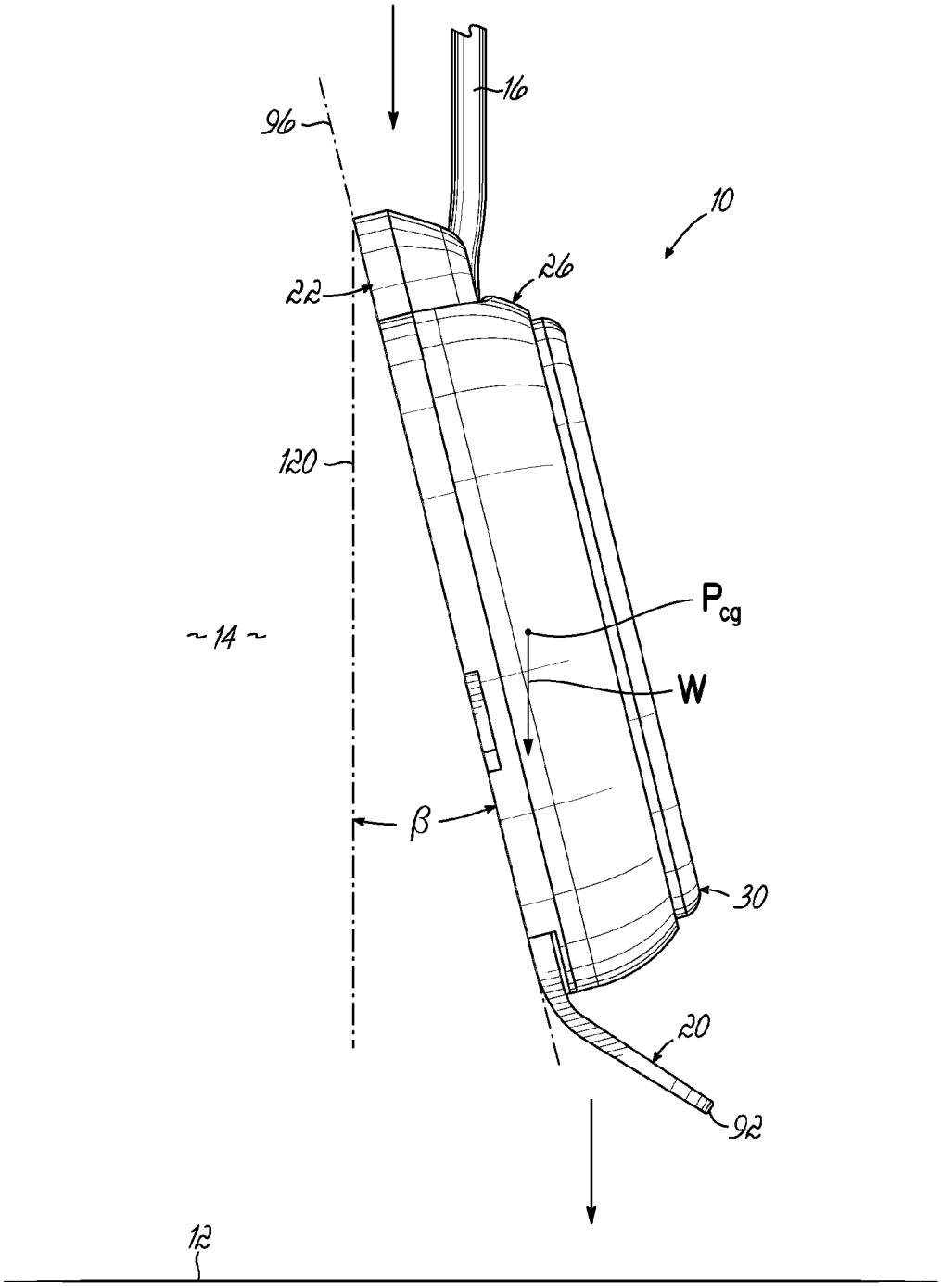
FIG. 4A is a side view of the foot pedal being lowered toward a working surface.

With the foot pedal 10 fully described above, a method of using the foot pedal 10 will now be described. As noted above, and in reference to FIGS. 4A and 4B, a preferred way of assembling the foot pedal 10 for a medical device 18 or to make a correction to the foot pedal 10 due to inadvertent movement during a medical procedure is to hold the foot pedal 10 by the cord 16 and lower the foot pedal 10 toward the working surface 12. As illustrated in FIG. 4A, using this method, the engagement tab 20 is out in front (e.g., it is at the lower most end of the foot pedal 10) and leads the way toward the working surface 12 such that the engagement tab 20 is the first aspect of the foot pedal 10 to contact the working surface 12. As additionally illustrated in FIG. 4A, the presence of the cord guide 22 at the interface of the housing 26 and the cord 16, and more particularly the angled nature of the channel 112 in the raised boss 100, causes the housing 26 of the foot pedal 10 to slightly pitch or cant relative to a vertical axis 120. In this regard, in an exemplary embodiment, the reference plane 96 may intersect vertical axis 120 at an acute angle $\beta$ between about 5° and about 45°. The angle $\beta$ may generally be no more than the angle $\alpha$, and in many cases, may be slightly less than the angle $\alpha$.

Figure 4B:
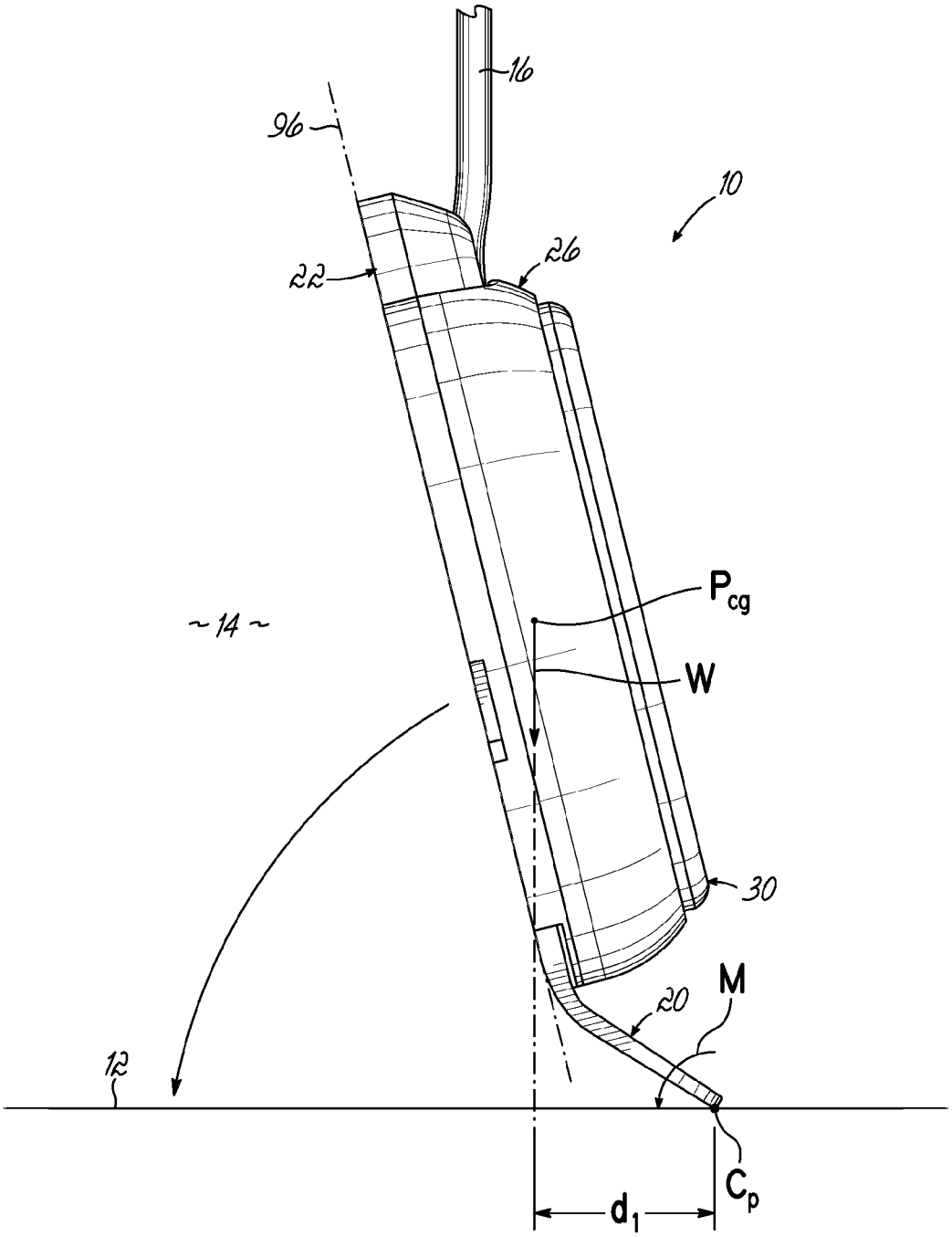
FIG. 4B is another side view of the foot pedal being lowered toward the working surface at the point the foot pedal contacts the working surface.

As the foot pedal 10 is lowered further, a contacting region of the engagement tab 20, which may be the free end 92 or an aspect of the engagement tab 20 adjacent the free end 92, contacts the working surface 12. This point is shown in FIG. 4B, for example, and illustrates that when the engagement tab 20 contacts the working surface 12, the contact point $C_p$ of the foot pedal 10 on the working surface 12 is horizontally spaced from the center of gravity $P_{cg}$ by a distance $d_1$. The contact point $C_p$ operates as a pivot point about which the foot pedal 10 will rotate, and the center of gravity $P_{cg}$ is the point through which the weight W of the foot pedal 10 acts. Due to the separation between these two points, the weight W of the foot pedal 10 generates a moment M about the pivot point established at $C_p$ that tends to rotate the foot pedal 10 about pivot point $C_p$ in a certain preferred direction. Given the particular configuration of the foot pedal 10, both of the self-leveling mechanisms generate a moment that rotates the foot pedal 10 about pivot point $C_p$ in a direction that moves the bottom of the foot pedal 10 (e.g., the reference plane 96) toward the working surface 12 (counterclockwise in FIG. 4B). This provides that the foot pedal 10 will be positioned on the working surface 12 in the proper, upright orientation.

Figure 5:
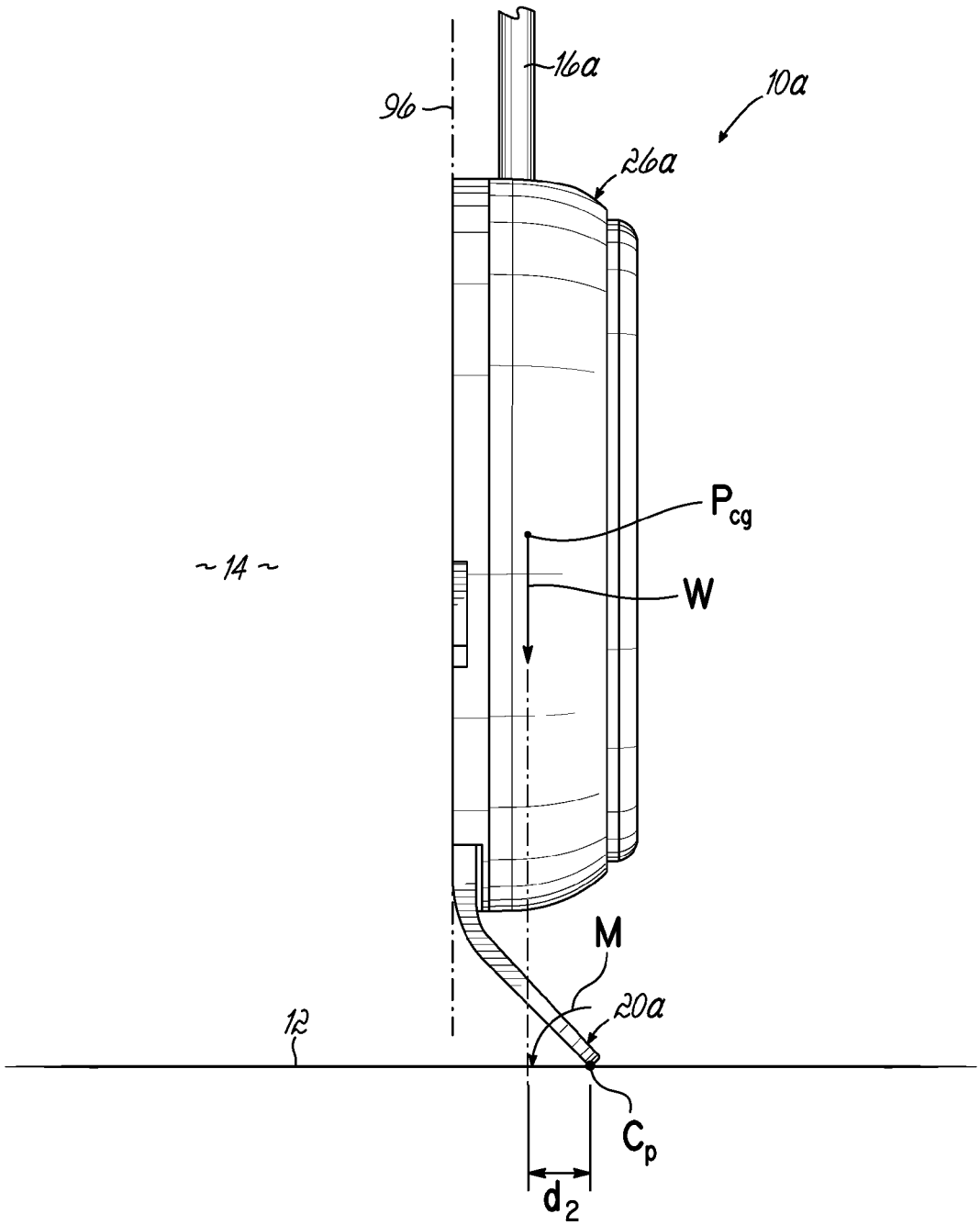
FIG. 5 is a side view of a foot pedal in accordance with another embodiment of the invention at the point the foot pedal contacts the working surface.

Of course, the greater the value of $d_1$ (e.g., the moment arm), the greater the moment M acting on the foot pedal 10 due to the weight W, and the greater the urging of the foot pedal 10 toward the proper, upright orientation. Having both self-leveling mechanisms incorporated into the foot pedal 10, i.e., both the engagement tab 20 and the cord guide 22, the greater the value of $d_1$. FIG. 5 illustrates an embodiment where the foot pedal 10*a* only includes the engagement tab 20*a* and not the cord guide 22. In this embodiment, the housing 26*a* of the foot pedal 10*a* and its cord 16*a* are essentially co-linear (e.g., the angle between the cord axis at the housing interface and the reference plane 96 is about 0°). In this case, the distance $d_2$ between the pivot point $C_p$ of the foot pedal 10*a* and the center of gravity $P_{cg}$ is provided by the engagement tab 20*a*.

It should be recognized that although there is only one self-leveling mechanism providing a separation between the pivot point $C_p$ and the center of gravity $P_{cg}$, the weight force W generates a moment M about the pivot point that tends to rotate the foot pedal 10*a* in a direction that moves the bottom of the foot pedal 10*a* (e.g., the reference plane 96) toward the working surface 12 (counterclockwise in FIG. 5). This provides that the foot pedal 10*a* will be positioned on the working surface 12 in the proper, upright orientation. In this embodiment of using only the engagement tab 20*a*, the tab 20*a* may be lengthened relative to the embodiment shown in FIGS. 4A and 4B so as to increase the separation between $C_p$ and $P_{cg}$ at contact of the foot pedal 10*a* with the working surface 12.

Figure 6:
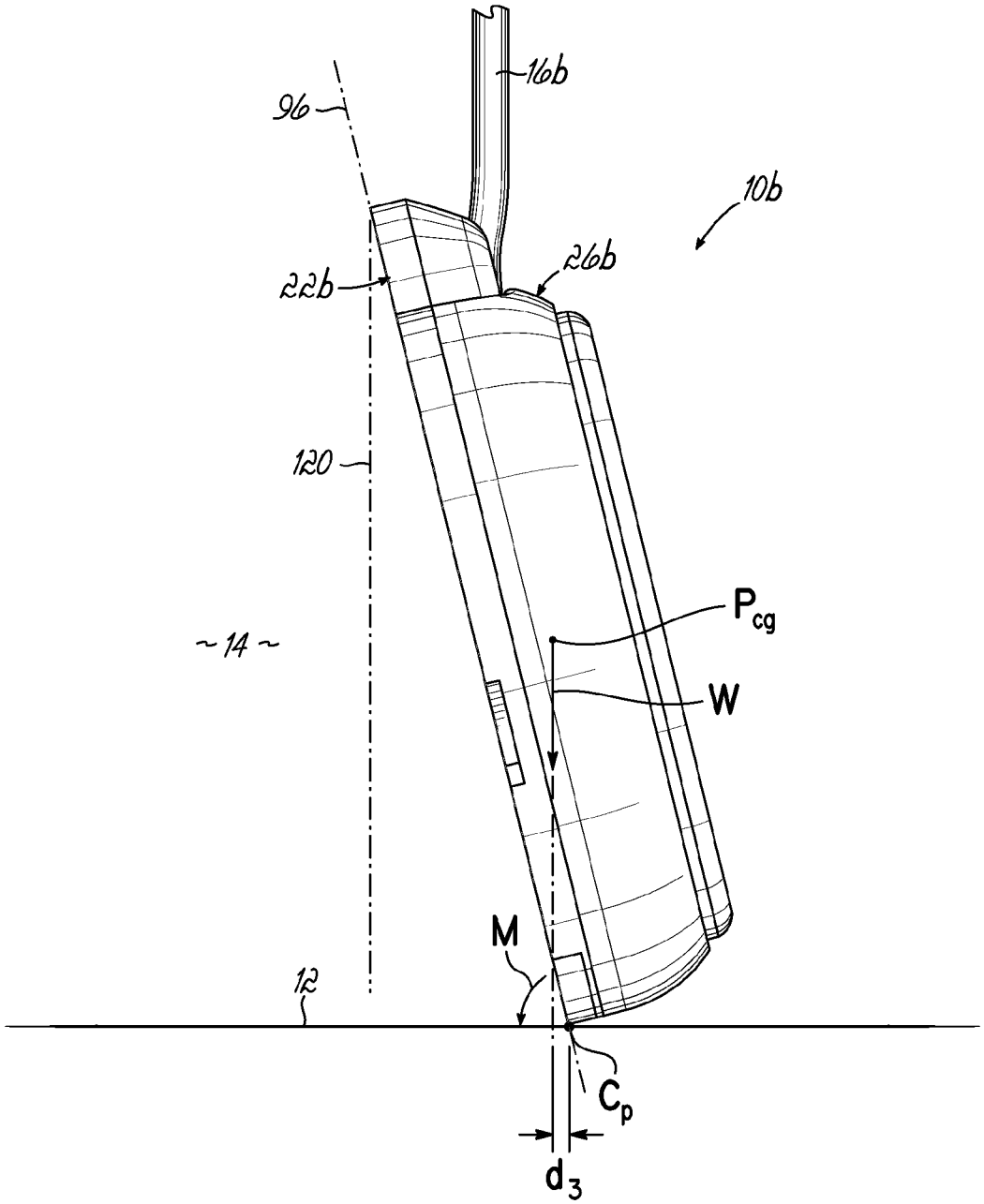
FIG. 6 is a side view of a foot pedal in accordance with another embodiment of the invention at the point the foot pedal contacts the working surface.

In a similar manner, FIG. 6 illustrates an embodiment where the foot pedal 10*b* only includes the cord guide 22*b* and not an engagement tab. In this embodiment, due to the presence of the cord guide 22*b*, the housing 26*b* of the foot pedal 10*b* remains pitched or canted relative to the vertical axis 120. In this case, the distance $d_3$ between the pivot point $C_p$ of the foot pedal 10*b* and the center of gravity $P_{cg}$ is provided by the pitched configuration of the foot pedal housing 26*b*. Although there is only one self-leveling mechanism providing a separation between the pivot point $C_p$ and the center of gravity $P_{cg}$, the weight force W generates a moment M about the pivot point that tends to rotate the foot pedal 10*b* in a direction that moves the bottom of the foot pedal 10*b* (e.g., the reference plane 96) toward the working surface 12 (counterclockwise in FIG. 6). This provides that the foot pedal 10*b* will be positioned on the working surface 12 in the proper, upright orientation. In this embodiment of using only the cord guide 22*b*, the angle $\alpha$ that the channel 112 makes relative to the reference plane 96 may be increased relative to the embodiment shown in FIGS. 4A and 4B so as to increase the angle $\beta$ indicative of the amount of pitch of the housing 26*b* of foot pedal 10*b* relative to the cord 16*b*. This, in turn, increases the separation between $C_p$ and $P_{cg}$ at contact of the foot pedal 10*b* with the working surface 12.

While the present invention has been illustrated by a description of various preferred embodiments and while these embodiments have been described in some detail, it is not the intention of the inventors to restrict or in any way limit the scope of the appended claims to such detail. Additional advantages and modifications will readily appear to those skilled in the art. For example, while the housing of the foot pedal has been described herein as having a two-part construction (e.g., upper and lower housing portions), the invention is not so limited. In various alternative embodiments, the housing of the foot pedal may be formed as a single part or have a plurality of parts that must be coupled to collectively form the housing. Thus, the various features of the invention may be used alone or in any combination depending on the needs and preferences of the user.

What is claimed is:

1. A foot pedal for a medical device configured for placement on a working surface of a medical operatory, comprising:

a housing having a lower base surface defining a bottom surface of the foot pedal, the bottom surface defining a reference plane at a location where the housing is configured to engage the working surface during use;

a cord having a first end coupled to a rear end of the housing and a second end configured to be coupled to the medical device; and an actuator coupled to the housing and configured to be actuated by a user to provide a control function for the medical device, wherein the housing includes a first self-leveling mechanism for urging the placement of the foot pedal on the working surface in an upright orientation, wherein the first self-leveling mechanism includes an engagement tab coupled to a front end of the housing, the engagement tab including a proximal edge that extends from the lower base surface and extends from the front end of the housing, and wherein the engagement tab is angled relative to the reference plane, and wherein the engagement tab includes a contact region defined on a distal edge thereof configured to contact the working surface prior to any other aspect of the foot pedal when the foot pedal is being lowered toward the working surface by the cord, the contact region having a first height above the reference plane that is greater than a second height of the foot pedal's center of gravity above the reference plane.

2. The foot pedal of claim 1, wherein the first height is between about 110% and about 160% of the second height.

3. The foot pedal of claim 1, wherein the engagement tab extends from the housing at a location generally opposite to where the cord extends from the housing.

4. The foot pedal of claim 1, wherein the engagement tab is angled relative to the reference plane between about 20° and about 75°.

5. The foot pedal of claim 1, further comprising a second self-leveling mechanism, the second self-leveling mechanism including a cord guide at the interface between the cord and the housing, wherein the cord guide is configured to pitch the housing so as to form an acute angle between a vertical axis and the reference plane when the foot pedal is being freely held by the cord.

6. The foot pedal of claim 5, wherein the cord guide pitches the housing so that the angle between the vertical axis and the reference plane is between about 5° and about 45°.

7. The foot pedal of claim 5, wherein the cord guide comprises a raised boss having an open channel formed in a surface thereof and configured to receive the cord therein, the open channel forming an acute angled relative to the reference plane.

8. The foot pedal of claim 7, wherein the open channel is angled relative to the reference plane between about 5° and about 45°.

9. The foot pedal of claim 1, wherein the housing includes an upper housing portion and a lower housing portion, wherein the first self-leveling mechanism forms a part of the lower housing portion.

10. A foot pedal for a medical or dental device comprising:

a housing having a lower base surface defining a bottom surface of the foot pedal, wherein the housing comprises a self-orienting mechanism including an engagement tab, the engagement tab including a proximal edge that extends from the lower base surface and extends away from a first end of the housing; and a cord coupled to a second end of the housing opposite the first end, wherein the engagement tab is configured to contact a working surface at a contact point defined at a distal edge of the engagement tab that is horizontally spaced from the foot pedal's center of gravity such that when the foot pedal is lowered to the working surface by the cord, a moment is generated by the foot pedal's weight to rotate the foot pedal in a direction that moves the bottom surface of the foot pedal toward the working surface.

11. The foot pedal of claim 10, wherein a centerline of the engagement tab is substantially aligned with a longitudinal axis of the cord.

12. The foot pedal of claim 10, wherein the engagement tab extends away from the housing.

13. The foot pedal of claim 10, wherein the engagement tab is angled relative to the bottom surface between about 20° and about 75°.

14. The foot pedal of claim 10, wherein the self-orienting mechanism includes a cord guide at the interface between the cord and the housing, wherein the cord guide angles the cord from the bottom surface.

15. The foot pedal of claim 14, wherein the cord guide angles the cord so that the angle of the cord from the bottom surface is between about 5° and about 45°.

16. The foot pedal of claim 15, wherein the cord guide comprises a raised boss with an open channel formed in its surface and configured to receive the cord, the open channel forming an acute angle relative to the bottom surface.

17. The foot pedal of claim 16, wherein the open channel is angled relative to the bottom surface between about 5° and about 45°.

* * * * *